US007584950B2

(12) United States Patent
Asada et al.

(10) Patent No.: US 7,584,950 B2
(45) Date of Patent: Sep. 8, 2009

(54) IMAGE FORMING APPARATUS AND SHEET FEEDING CASSETTE

(75) Inventors: Tetsuo Asada, Nagoya (JP); Yukio Shiohara, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 78 days.

(21) Appl. No.: 11/670,009

(22) Filed: Feb. 1, 2007

(65) Prior Publication Data

US 2007/0182083 A1 Aug. 9, 2007

(30) Foreign Application Priority Data

Feb. 3, 2006 (JP) ..... 2006-027293

(51) Int. Cl.
*B65H 3/44* (2006.01)
*B65H 1/00* (2006.01)

(52) U.S. Cl. ..... 271/9.07; 271/9.08; 271/9.11; 271/9.13; 271/162; 271/164

(58) Field of Classification Search ..... 271/9.06, 271/9.07, 9.13, 9.08, 145, 171, 162
See application file for complete search history.

(56) References Cited

U.S. PATENT DOCUMENTS

| | | | | |
|---|---|---|---|---|
| 5,069,435 | A * | 12/1991 | Mizutani | 271/9.09 |
| 5,120,040 | A * | 6/1992 | Worley | 271/9.07 |
| 5,261,651 | A * | 11/1993 | Ishida | 271/3.2 |
| 5,511,770 | A * | 4/1996 | Okazaki | 271/4.01 |
| 5,737,682 | A * | 4/1998 | Yamagishi | 399/402 |
| 6,406,201 | B1 * | 6/2002 | Beretta et al. | 400/605 |
| 6,547,288 | B1 | 4/2003 | Ito et al. | |
| 7,261,290 | B2 * | 8/2007 | Funk et al. | 271/171 |

(Continued)

FOREIGN PATENT DOCUMENTS

JP S61-127531 A 6/1986

(Continued)

OTHER PUBLICATIONS

Japan Patent Office, Office Action in counterpart Patent Application No. JP 2006-027293 mailed Jul. 8, 2008.

(Continued)

*Primary Examiner*—Patrick H Mackey
*Assistant Examiner*—Luis Gonzalez
(74) *Attorney, Agent, or Firm*—Baker Botts L.L.P.

(57) ABSTRACT

An image forming apparatus including: a print part; a feeding part; a first sheet feeding tray; and a second sheet feeding tray. The first sheet feeding tray stores a sheet of a first size therein, the feeding part feeding the sheet of the first size from the first sheet feeding tray to the print part in a sheet feeding direction. The second sheet feeding tray is mounted on the first sheet feeding tray and stores a sheet of a second size smaller than the first size therein, the feeding part feeding the sheet of the second size from the second sheet feeding tray to the print part in the sheet feeding direction, the second sheet feeding tray receiving a sheet printed by the print part and discharged in a direction opposite to the sheet feeding direction. The second sheet feeding tray has a pair of side guides which are provided in parallel to the sheet feeding direction and which contact against side ends of the sheet of the second side to guide the sheet of the second side to the print part. At least one of the pair of side guides is provided with a plate part which extends from an upper edge of the side guide to the other side guide and which receives the printed sheet thereon. The plate part has a backward-feed prevention part which prevents the printed sheet from being fed to the print part again.

6 Claims, 7 Drawing Sheets

U.S. PATENT DOCUMENTS

2005/0242485 A1 11/2005 Shiohara et al.

FOREIGN PATENT DOCUMENTS

| | | | |
|---|---|---|---|
| JP | H04-246050 | A | 9/1992 |
| JP | H06-312551 | A | 11/1994 |
| JP | H07-002345 | A | 1/1995 |
| JP | H07-2345 | U | 1/1995 |
| JP | H11-227992 | A | 8/1999 |
| JP | 2002-68535 | A | 3/2002 |
| JP | 2005-314067 | A | 11/2005 |

OTHER PUBLICATIONS

Japan Patent Office, Decision of Rejection in counterpart Patent Application No. JP 2006-027293 mailed Nov. 11, 2008.

* cited by examiner

IMAGE FORMING APPARATUS AND SHEET FEEDING CASSETTE

CROSS REFERENCE TO RELATED APPLICATION

This application claims priority from Japanese Patent Application No. 2006-27293 filed Feb. 3, 2006. The entire content of this priority application is incorporated herein by reference.

TECHNICAL FIELD

The present invention relates to an image forming apparatus for printing an image on a sheet held in a sheet feeding tray.

BACKGROUND

In the conventional image forming apparatuses such as facsimile machines and printers, a sheet feeding tray for feeding a printing sheet and a sheet discharge tray for stocking a discharged sheet therein are separately provided. Japanese Unexamined Patent Application Publication No. 6-312551 discloses a recording device which feeds and discharges a sheet by the same conveyance roller. Japanese Unexamined Patent Application Publication No. 7-2345 discloses a document reader in which a sheet feeding tray is formed integrally with a sheet discharge tray.

SUMMARY

According to the recording device described in Japanese Unexamined Patent Application Publication No. 6-312551, the recording device is reduced in size by feeding and discharging the sheet using the same conveyance roller. Similarly, according to the document reader described in Japanese Unexamined Patent Application Publication No. 7-2345, the document reader is reduced in size by forming the sheet feeding tray and the sheet discharge tray in an integral fashion. However, with the configuration described in those publications, when a plurality of sheets to be fed are stacked, a discharged, printed sheet will possibly contact against the sheets to be fed and the printed sheet will possibly be wrongly fed to the print part again. As a result, paper jam can occur on a conveyance path or a desired image cannot be formed.

In view of the foregoing, it is an object of the invention to provide an image forming apparatus and a sheet feeding cassette which can smoothly discharge a sheet while using a tray that can serve as both of a sheet feeding tray and a sheet discharge tray.

In order to attain the above and other objects, the invention provides an image forming apparatus including: a print part; a feeding part; a first sheet feeding tray; and a second sheet feeding tray. The first sheet feeding tray is stores a sheet of a first size therein, the feeding part feeding the sheet of the first size from the first sheet feeding tray to the print part in a sheet feeding direction. The second sheet feeding tray is mounted on the first sheet feeding tray and stores a sheet of a second size smaller than the first size therein, the feeding part feeding the sheet of the second size from the second sheet feeding tray to the print part in the sheet feeding direction, the second sheet feeding tray receiving a sheet printed by the print part and discharged in a direction opposite to the sheet feeding direction. The second sheet feeding tray has a pair of side guides which are provided in parallel to the sheet feeding direction and which contact against side ends of the sheet of the second side to guide the sheet of the second side to the print part. At least one of the pair of side guides is provided with a plate part which extends from an upper edge of the side guide to the other side guide and which receives the printed sheet thereon. The plate part has a backward-feed prevention part which prevents the printed sheet from being fed to the print part again.

According to another aspect, the invention provides a sheet feeding cassette which can be attached to and detached from an image forming apparatus having a print part and a feeding part. The sheet feeding cassette includes: a first sheet feeding tray; and a second sheet feeding tray. The first sheet feeding tray stores a sheet of a first size therein, the feeding part feeding the sheet of the first size from the first sheet feeding tray to the print part in a sheet feeding direction. The second sheet feeding tray is mounted on the first sheet feeding tray and stores a sheet of a second size smaller than the first size therein, the feeding part feeding the sheet of the second size from the second sheet feeding tray to the print part in the sheet feeding direction, the second sheet feeding tray receiving a sheet printed by the print part and discharged in a direction opposite to the sheet feeding direction. The second sheet feeding tray has a pair of side guides which are provided in parallel to the sheet feeding direction and which contact against side ends of the sheet of the second side to guide the sheet of the second side to the print part. At least one of the pair of side guides is provided with a plate part which extends from an upper edge of the side guide to the other side guide and which receives the printed sheet thereon. The plate part has a backward-feed prevention part which prevents the printed sheet from being fed to the print part again.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
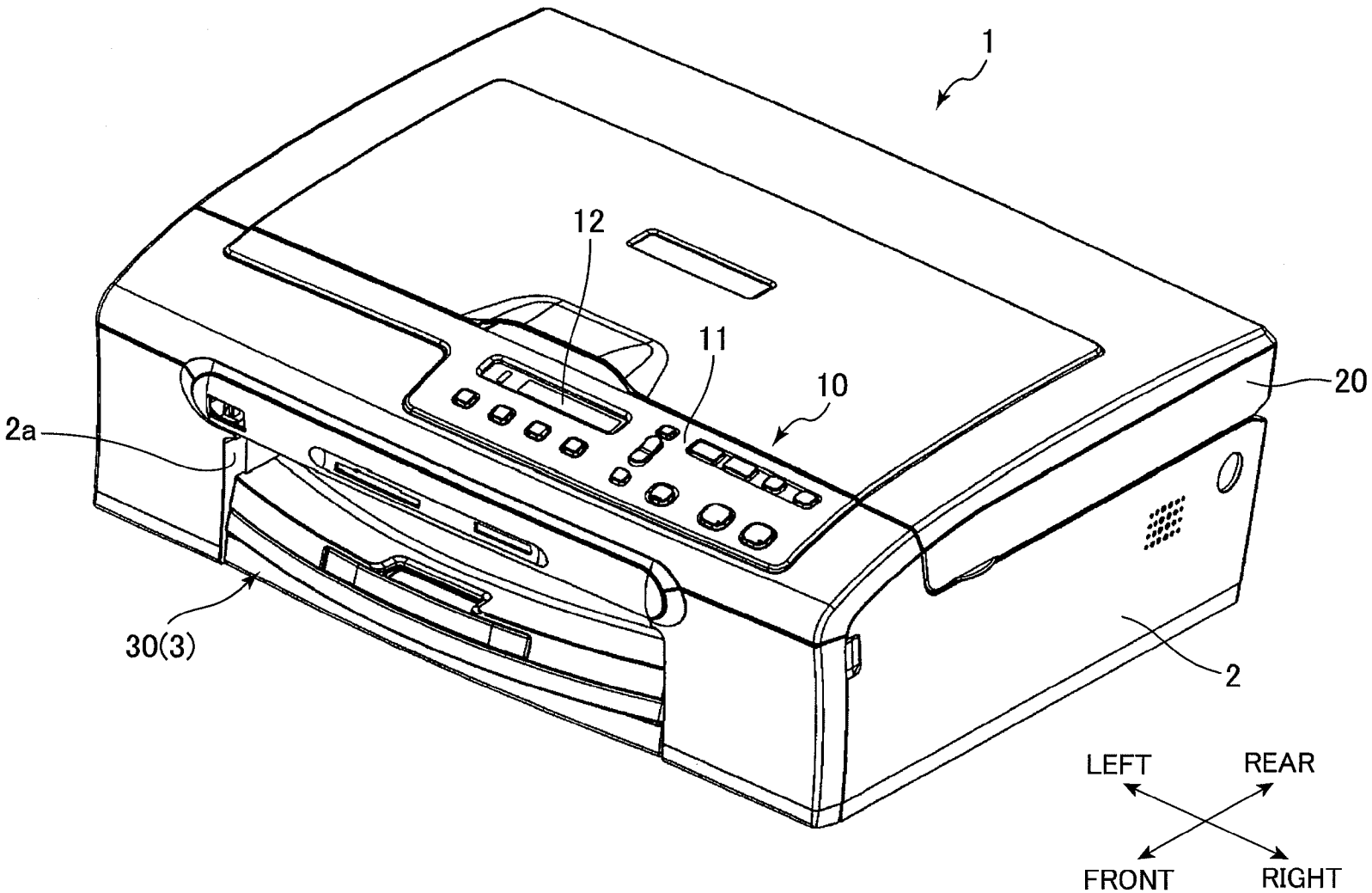
FIG. 1 is a perspective view showing an outer appearance of an image forming apparatus according to an embodiment of the invention.

An image forming apparatus and a sheet feeding cassette according to an embodiment of the invention will be described while referring to the accompanying drawings wherein like parts and components are designated by the same reference numerals to avoid duplicating description.

First, with reference to FIG. 1, overall configuration of an image forming apparatus 1 in accordance with the embodiment will be described.

FIG. 1 is a perspective view showing an external appearance of the image forming apparatus 1. In the following descriptions, the vertical direction is represented with reference to the normal use state of the image forming apparatus 1 (the state shown in FIG. 1), the front-back direction is represented using the side on which an operation panel 10 described later as a near side (front) and the widthwise direction is represented when viewing the image forming apparatus 1 from the near side (front).

The image forming apparatus 1 is a so-called multifunction apparatus having scanning, color-copying and facsimile functions in addition to a printing function. The exterior of the image forming apparatus 1 is defined by a main body casing 2 that is made from a resin rectangular box-shaped member.

The operation panel 10 is provided on the front portion of an upper surface of the main body casing 2. The operation panel 10 has an operation part 11, on which various operation buttons for an input operation are formed, and a display part (for example, a liquid crystal display) 12, on which an image such as a message is displayed. A scanner unit 20 for reading an image from a document is provided in the rear of the operation panel 10. The scanner unit 20 is used to perform the scanning, color-copying and facsimile functions.

On the other hand, a sheet feeding cassette 3 is provided in a lower portion of the main body casing 2. The sheet feeding cassette 3 can store therein a stack of a plurality of sheet-shaped recording media, such as papers and plastic sheets, so that each sheet-shaped recording medium extends substantially horizontally. Configuration of the sheet feeding cassette 3 will be described later in detail.

Figure 5:
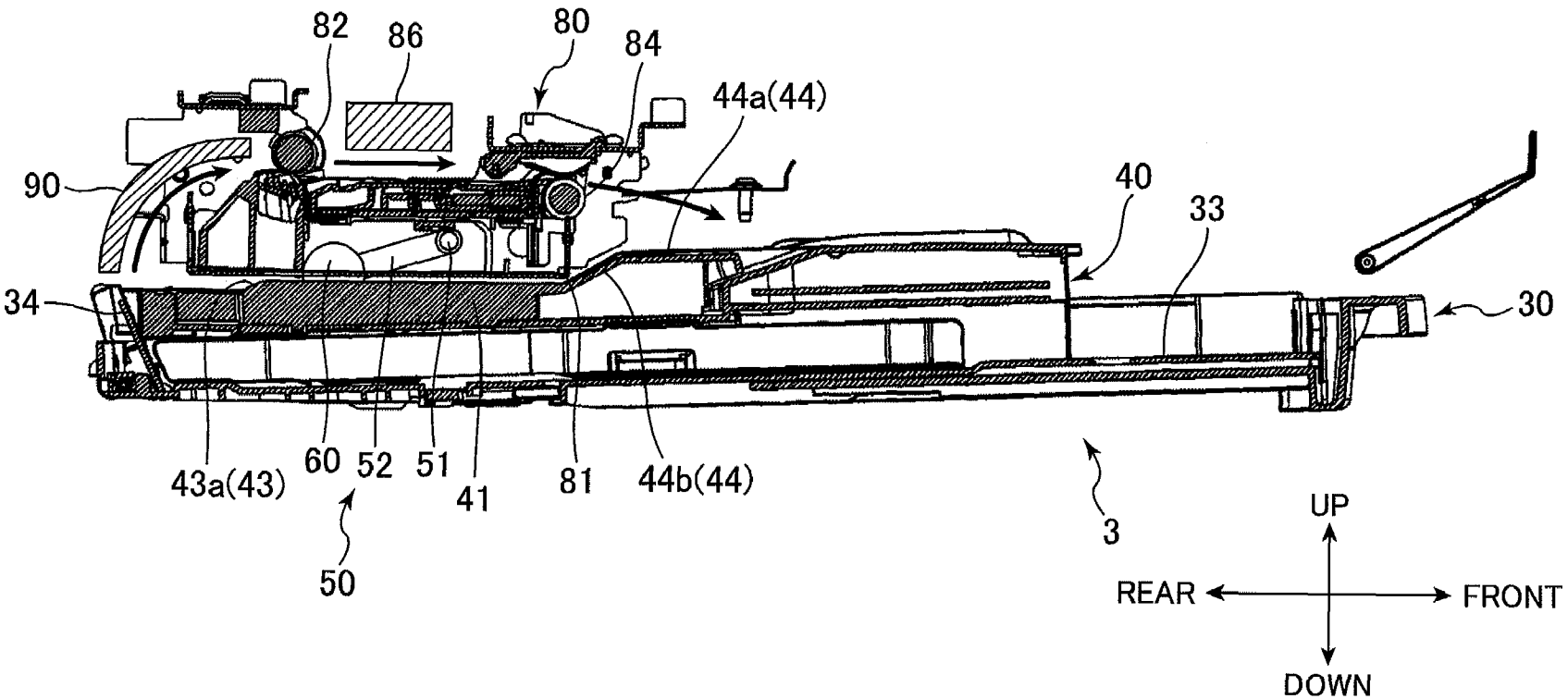
FIG. 5 is a side sectional view showing the positional relationship between the print unit and the sheet feeding cassette when the sheet feeding cassette is mounted in the image forming apparatus and the second sheet feeding tray is slid rearward on the first sheet feeding tray.
Figure 7:
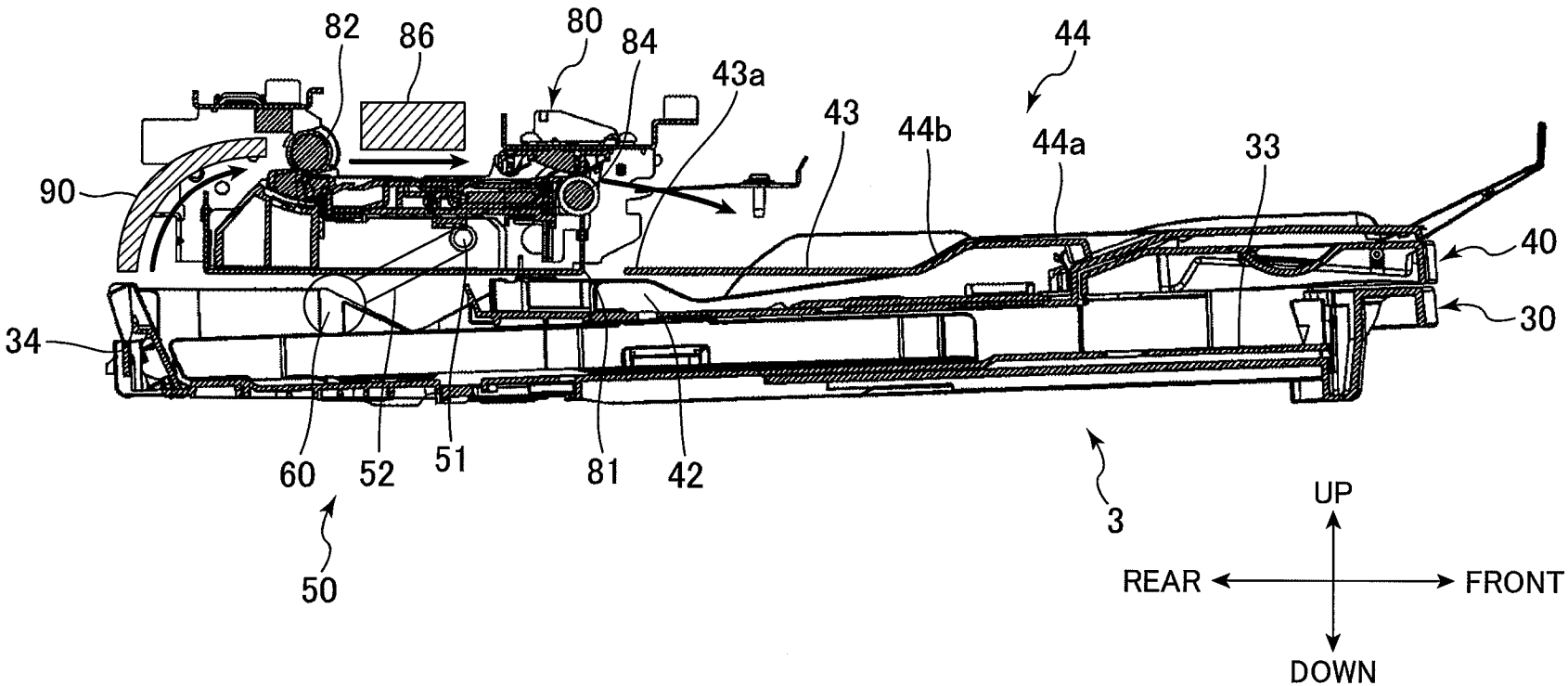
FIG. 7 is a side sectional view showing the positional relationship between the print unit and the sheet feeding cassette when the sheet feeding cassette is mounted in the image forming apparatus and the second sheet feeding tray is slid frontward on the first sheet feeding tray.

A U-shaped conveyance guide 90 is formed as shown in FIG. 5 and V at the rear end of the main body casing 2 to guide the recording medium that has been conveyed rearward from the sheet feeding cassette 3 by a feeding unit 50 (to be described later) so that the recording medium will turn around upward and then move frontward as indicated by an arrow in the figures. As also shown in FIGS. 5 and 7, an image recording unit 80 is provided in the main casing 2 at a location in front of the U-shaped conveyance guide 90 and above the sheet feeding cassette 3 when the sheet feeding cassette 3 is attached to the main body casing 2. The image recording unit 80 serves as a print part for forming (printing) an image on the recording medium. The recording medium on which the image is recorded is discharged in the forward direction toward a position near the front on the upper surface of the sheet feeding cassette 3 as also indicated by an arrow in the figures.

Figure 4:
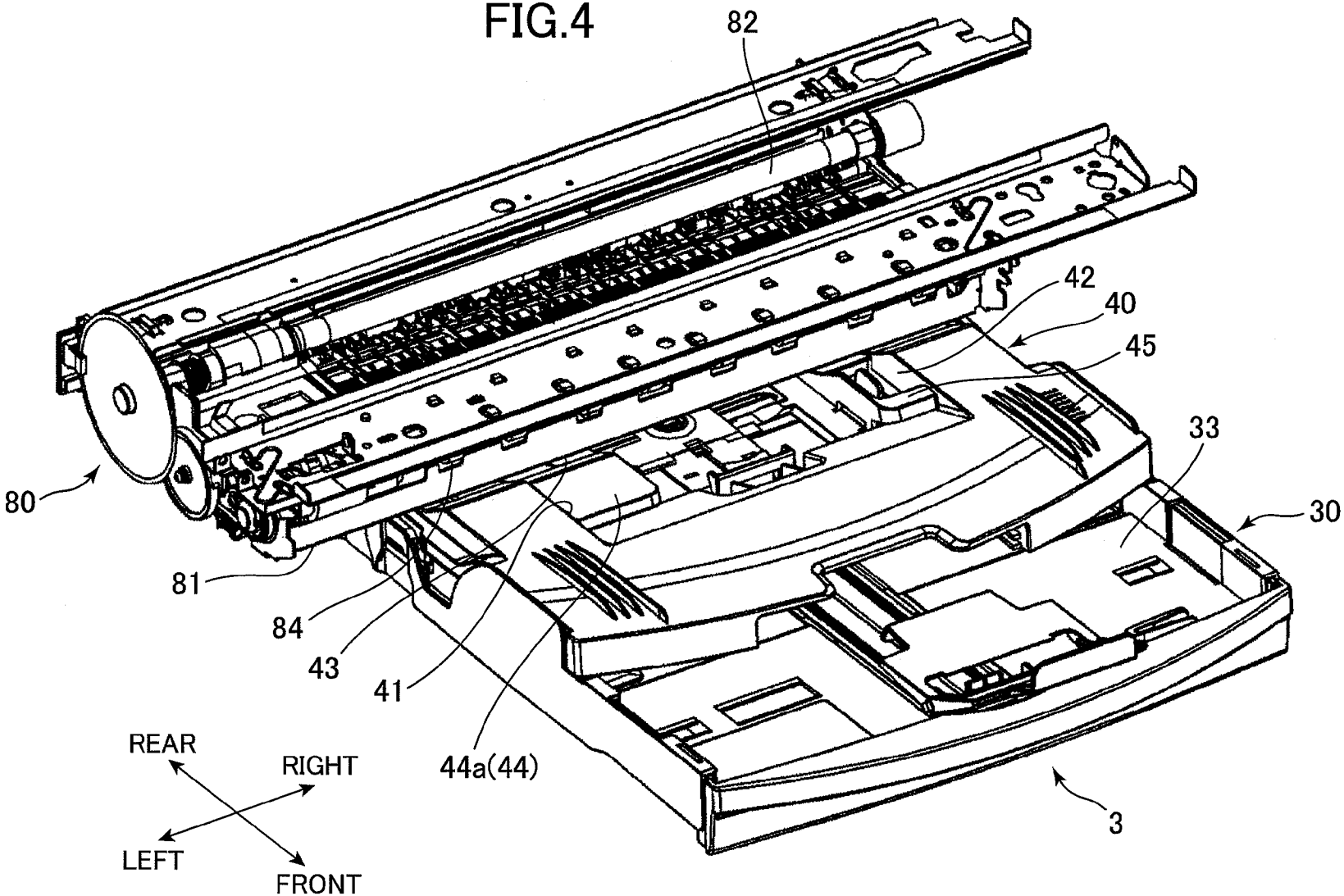
FIG. 4 is a perspective view showing the positional relationship between a print unit and the sheet feeding cassette when the sheet feeding cassette is mounted in the image forming apparatus and the second sheet feeding tray is slid rearward on the first sheet feeding tray.

More specifically, as shown in FIGS. 4, 5 and 7, the print unit 80 has a PF (paper feed) roller 82 and a plurality of discharge rollers 84. The discharge rollers 84 are provided in front of the PF roller 82. In the print unit 80, a sheet conveying path is defined to extend in the rear-to-front direction below the PF roller 82 and above the discharge rollers 84 as indicated by an arrow in FIGS. 5 and 7. As shown in FIGS. 5 and 7, a print head 86 is provided as being movable along a moving path that is located between the PF roller 82 and the discharge rollers 84 and that extends in the widthwise direction. The sheet is conveyed by the PF roller 82 in the forward direction, while being printed by the print head 86 that is moving above the sheet, and then is discharged by the discharge rollers 84 onto the sheet feeding cassette 3.

Next, configuration of the sheet feeding cassette 3 will be described with reference to FIG. 2 and FIG. 3.

Figure 2:
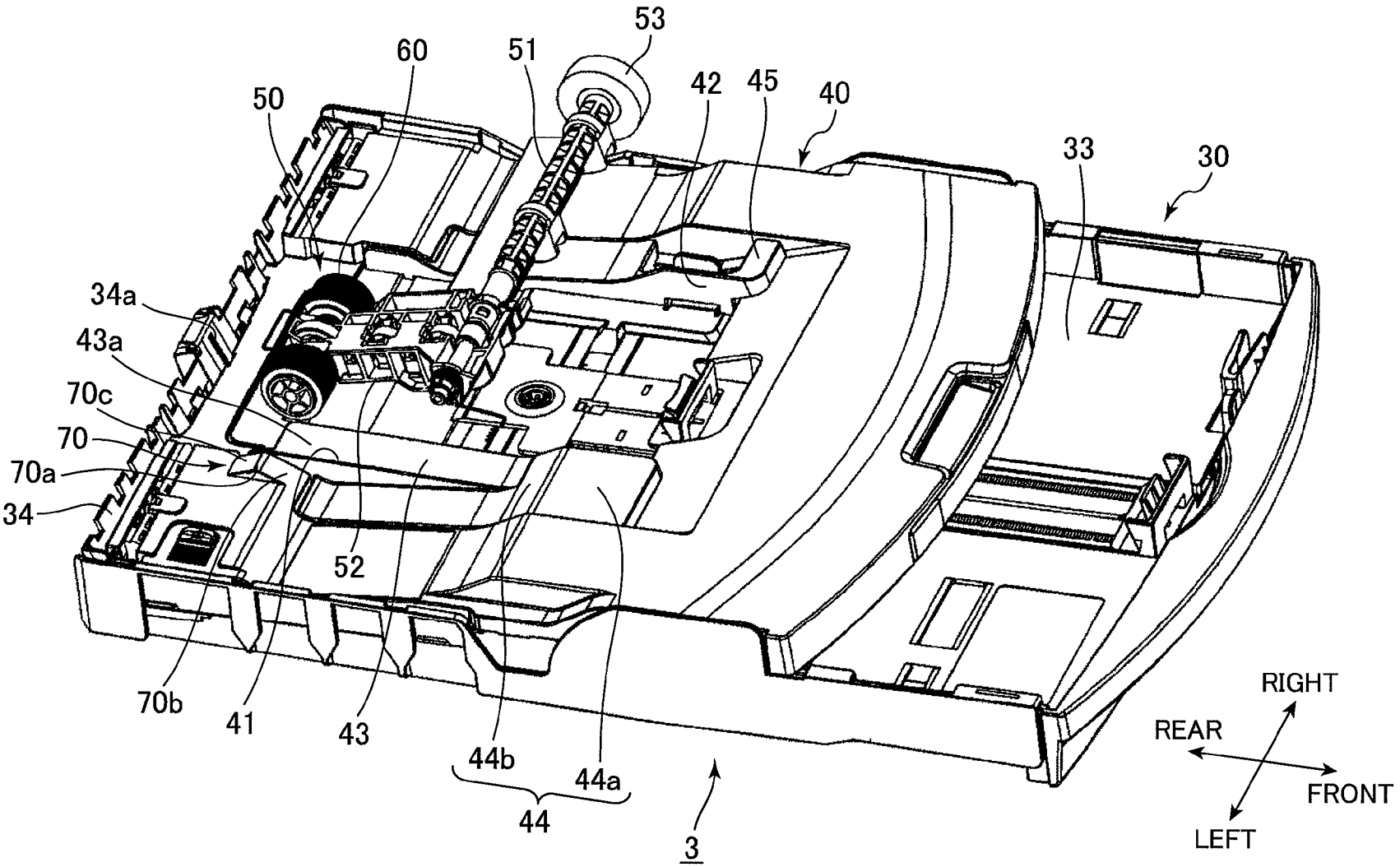
FIG. 2 is a perspective view of a sheet feeding cassette in the state where a second sheet feeding tray is closed.
Figure 3:
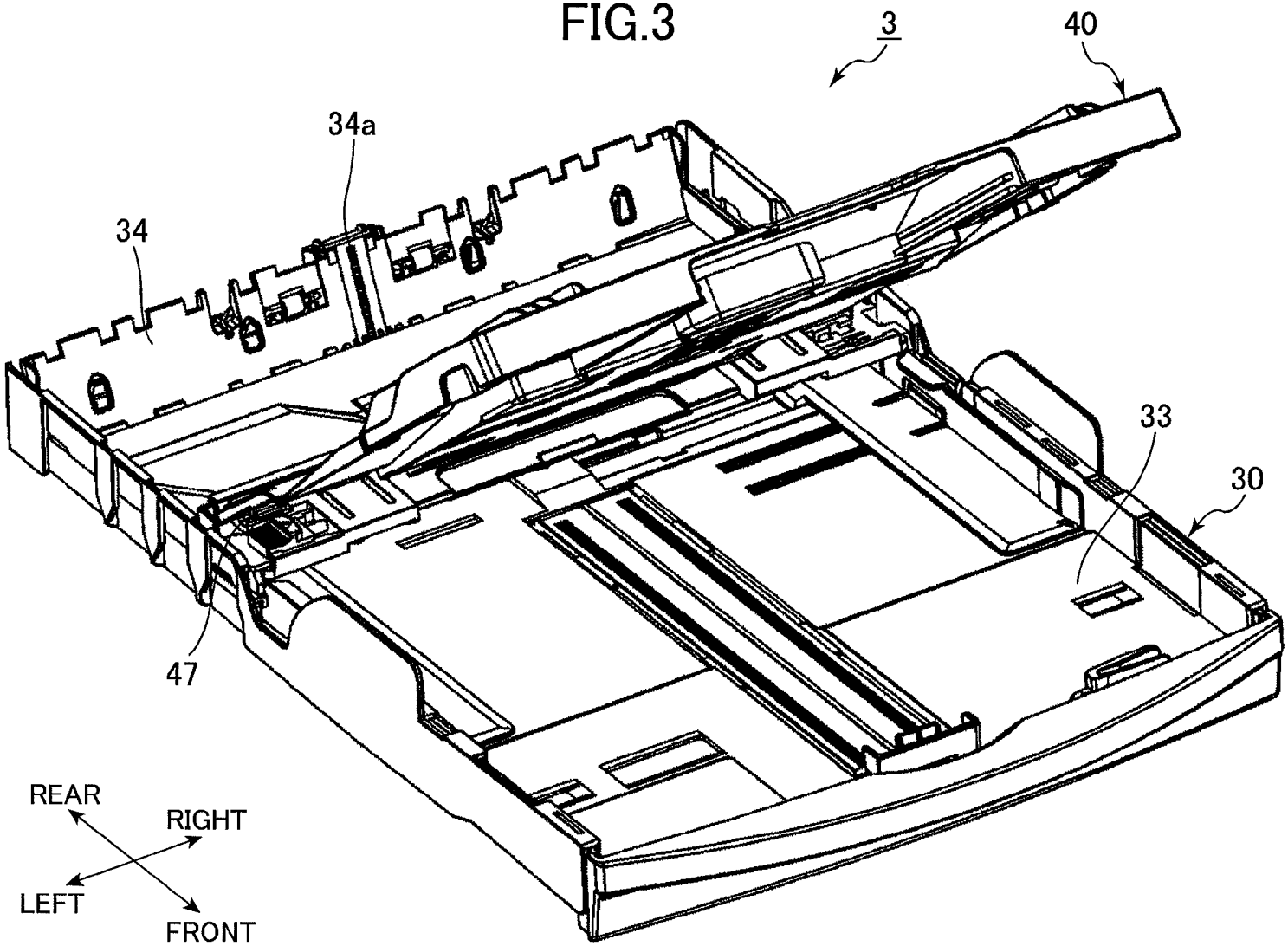
FIG. 3 is a perspective view of the sheet feeding cassette in the state where the second sheet feeding tray is opened.

FIG. 2 is a perspective view showing the sheet feeding cassette 3 in the state where a second sheet feeding tray 40 to be described later is closed. FIG. 3 is a perspective view showing the sheet feeding cassette 3 in the state where the second sheet feeding tray 40 is opened.

The sheet feeding cassette 3 is configured from a first sheet feeding tray 30 and the second sheet feeding tray 40. The first sheet feeding tray 30 is for storing a stack of standard sized sheets therein and for feeding the standard sized sheets to the print part 80 in a sheet feeding direction (rearward direction). The second sheet feeding tray 40 is mounted on the first sheet feeding tray 30, and is for storing therein a stack of smaller-sized sheets whose size is smaller than the standard sized sheets, for feeding the smaller-sized sheets to the print part 80 in the sheet feeding direction (rearward direction), and further for serving as a sheet discharge tray for receiving a printed sheet that is discharged from the print part 80 in the direction opposite to the sheet feeding direction, that is, in the forward direction. As shown in FIG. 1, the sheet feeding cassette 3 is configured so as to be detachable from the main body casing 2. That is, the sheet feeding cassette 3 can be horizontally pulled out forward from an opening 2*a* that is formed on the front surface of the main body casing 2, and can be attached to the main body casing 2 by being horizontally inserted through the opening 2*a* into the main body casing 2.

As shown in FIGS. 2, 5, and 7, a feeding unit 50 is provided in the main casing 2 at a location below the print unit 80 and above the sheet feeding cassette 3 when the sheet feeding cassette 3 is mounted in the main body casing 2. The feeding unit 50 has a support shaft 51 which is supported by a frame (not shown) provided in the main body casing 2 and which extends in the range from the center to the right end of the sheet feeding cassette 3 in the widthwise direction when the sheet feeding cassette 3 is mounted in the main body casing 2. A large gear 53 is fixed at a right end of the support shaft 51 and a small gear (not shown) having the same diameter as the support shaft 51 is fixed in the vicinity of a left end of the support shaft 51. The feeding unit 50 has an arm member 52 which is supported by the support shaft 51 and which is configured to be swingable around the support shaft 51 in the state where its tip end is lowered rearward. A feeding roller 60 is rotatably supported at the tip end (swinging end) of the arm member 52. The rotational axis of the feeding roller 60 extends in the widthwise direction. The arm member 52 is swingable around its swinging axis. The swinging axis of the arm member 52 extends parallel to the rotational axis of the feeding roller 60. The swinging axis of the arm member 52 is located above the sheets stored in the sheet feeding cassette 3, and on the front side of the rotational axis of the feeding roller 60, that is, on the upstream side of the rotational axis of the feeding roller 60 in the feeding direction of the recording medium by the feeding roller 60.

As shown in FIG. 2, the first sheet feeding tray 30 is a resin-made rectangular tray-shaped member having a substantially A4 size when viewed from above. The first sheet feeding tray 30 has a bottom plate 33, and can store a plurality of recording mediums in a stacked state on the bottom plate 33. The first sheet feeding tray 30 can store standard-sized sheets (A4 size sheets, for example) on the bottom plate 33. The first sheet feeding tray 30 further has a pair of side end guides (not shown), thereby positioning the center line of the recording mediums in the widthwise direction irrespective the size of the stored recording mediums. Thus, the recording mediums stored in the first sheet feeding tray 30 and positioned by the side end guides are prevented from moving or inclining in the widthwise direction (direction of the rotational axis of the feeding roller 60), while being fed by the feeding roller 60 in the feeding direction (rearward direction).

The first sheet feeding tray 30 has a guide plate 34 at its rear end. A metal separating member 34*a* is provided at the center of the guide plate 34 in the widthwise direction. The separating member 34*a* has a plurality of teeth which are arranged at regular intervals in the vertical direction and a front end of each tooth slightly protrudes from the front surface of the guide plate 34. Thus, the plurality of recording mediums pushed by the feeding roller 60 of the feeding unit 50 contact against the front ends of the teeth, so that an uppermost recording medium is separated from remaining mediums and is supplied to the U-shaped conveyance guide 90 (FIGS. 5 and 7).

The second sheet feeding tray 40 is attached to the first sheet feeding tray 30 so as to be slidable relative to the first sheet feeding tray 30 in the front-back direction. The second sheet feeding tray 40 can store thick and small-sized recording mediums, such as sheets for picture and postcards, in its central part in the widthwise direction. That is, the second sheet feeding tray 40 can store recording mediums with sizes smaller than the standard size of the sheets stored in the first sheet feeding tray 30. As shown in FIG. 3, the second sheet feeding tray 40 can rotate around a shaft 47 so as to be opened upward. By opening the second sheet feeding tray 40, sheets can be mounted on the first sheet feeding tray 30 and below the second sheet feeding tray 40.

The second sheet feeding tray 40 is a resin-made rectangular tray-shaped member. The second sheet feeding tray 40 is almost the same as the first sheet feeding tray 30 in size in the widthwise direction and slightly smaller than the first sheet feeding tray 30 in size in the front-back direction. The second sheet feeding tray 40 is configured to store therein a stack of a plurality of recording mediums with each recording medium extending in the horizontal direction.

More specifically, although not shown in the drawings, a groove is formed on each of left and right side walls of the first sheet feeding tray 30 to extend in the front-to-rear direction. The left and right side ends of the shaft 47 are slidably engaged with the grooves on the left and right side walls of the first sheet feeding tray 30. With this configuration, the second sheet feeding tray 40 can move in the front-to-rear direction relative to the first sheet feeding tray 30 by sliding the shaft 47 along the grooves. FIG. 5 shows the case where the second sheet feeding tray 40 is positioned on the rear side of the first sheet feeding tray 30, while FIG. 7 shows the case where the second sheet feeding tray 40 is positioned on the front side of the first sheet feeding tray 30. It is noted that the grooves are formed on the left and right side walls of the first sheet feeding tray 30 so as to be inclined downwardly toward the rear when the first sheet feeding tray 30 is oriented to extend horizontally. When the sheet feeding cassette 3 is mounted in the image forming apparatus 1, the first sheet feeding tray 30 is oriented to extend horizontally in the image forming apparatus 1. So, in the case where the sheet feeding cassette 3 is mounted in the image forming apparatus 1, when the second sheet feeding tray 40 moves from the rear side (FIG. 5) toward the front side (FIG. 7) on the first sheet feeding tray 30, the second sheet feeding tray 40 moves gradually upwardly in the image forming apparatus 1.

As shown in FIG. 2, as in the first sheet feeding tray 30, the second sheet feeding tray 40 has a pair of side end guides 41 and 42. The side end guides 41 and 42 rise from the upper surface of the second sheet feeding tray 40. The side end guides 41 and 42 are for positioning the center line of the recording mediums in the widthwise direction irrespective the size of the stored recording mediums. The sheets stored in the second sheet feeding tray 40 are smaller than the standard-sized sheets stored in the first sheet feeding tray 30. The side end guides 41 and 42 extend in parallel to the sheet feeding direction (rearward direction), in which the feeding unit 50 feeds the sheet from the second sheet feeding tray 40, and come into contact with side ends of the stored sheets to guide the sheets to the U-shaped conveyance guide 90.

In the state where the second sheet feeding tray 40 is placed in the rear side on the first sheet feeding tray 30 (position shown in FIGS. 2, 4, and 5), the recording mediums stored in the second sheet feeding tray 40 prevent the feeding roller 60 from moving downward toward the first sheet feeding tray 30. For this reason, the feeding roller 60 of the feeding unit 50 comes into contact with the recording mediums stored in the second sheet feeding tray 40, not the recording mediums stored in the first sheet feeding tray 30, thereby feeding the recording medium stored in the second sheet feeding tray 40 to the U-shaped conveyance guide 90.

In the state where the second sheet feeding tray 40 is placed in the front side on the first sheet feeding tray 30 (position shown in FIGS. 6 and 7), the feeding roller 60 moves downward toward the first sheet feeding tray 30. For this reason, the feeding roller 60 of the feeding unit 50 comes into contact with the recording mediums stored in the first sheet feeding tray 30, thereby feeding the recording medium stored in the first sheet feeding tray 30 to the U-shaped conveyance guide 90.

Figure 6:
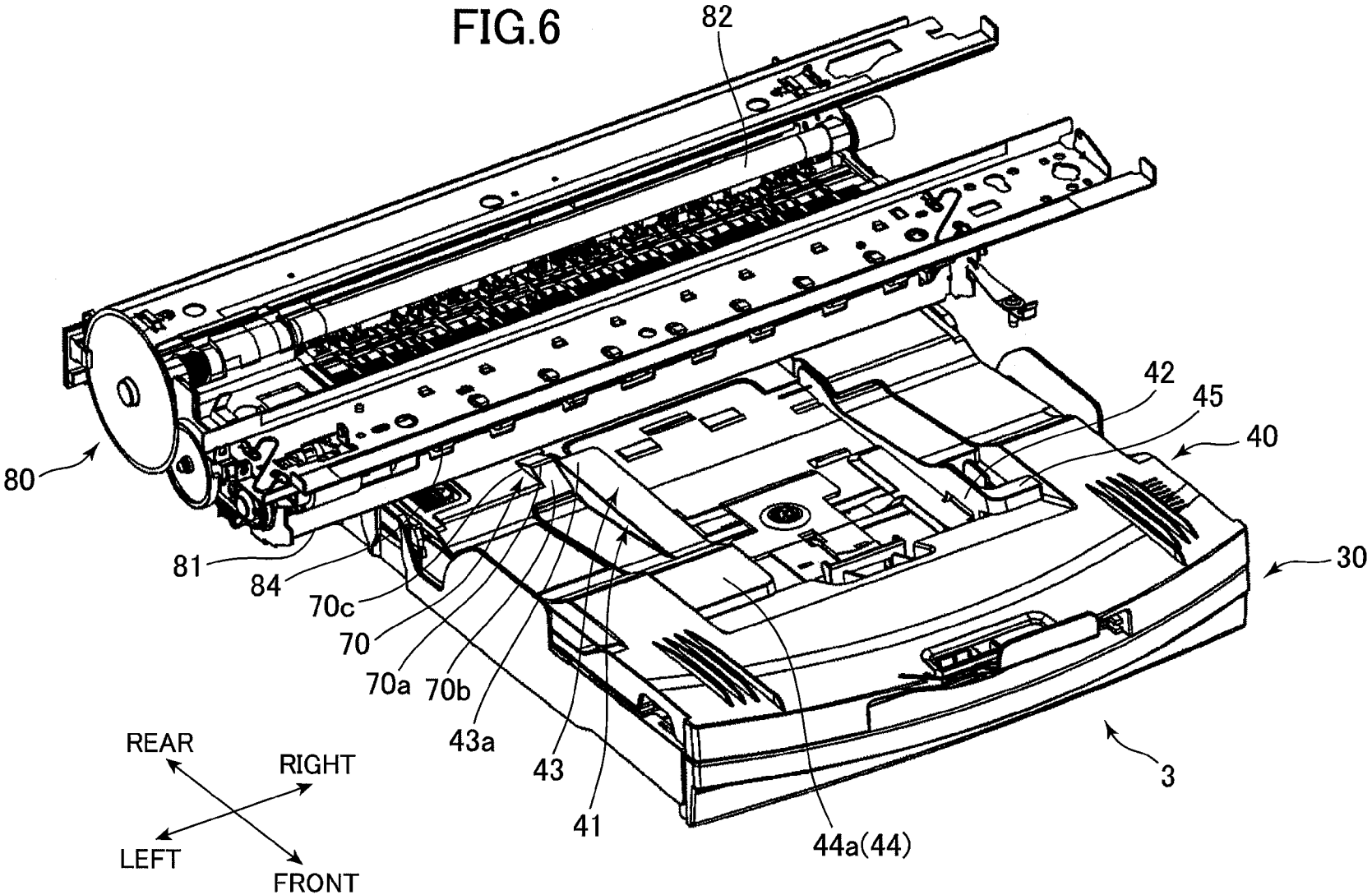
FIG. 6 is a perspective view showing the positional relationship between the print unit and the sheet feeding cassette when the sheet feeding cassette is mounted in the image forming apparatus and the second sheet feeding tray is slid frontward on the first sheet feeding tray.

As shown in FIGS. 2, 6, and 7, a plate part 43 for receiving the printed sheet discharged from the print part 80 is formed at the side end guide 41. The plate part 43 is a flat plate-shaped member which extends from an upper edge of the side end guide 41 in a direction perpendicularly to the plate-shaped side end guide 41 toward the side end guide 42. That is, the plate part 43 extends horizontally parallel to the upper surface of the second sheet feeding tray 40. The plate part 43 together with the upper surface of the second sheet feeding tray 40 function as the sheet discharge tray. That is, the plate part 43 can separately mount the pre-printed sheet stored therebelow and the printed sheet discharged thereon. In other words, the sheet printed by the print head 86 is discharged by the discharge rollers 84 onto the plate part 43, while pre-printed sheets are mounted below the plate part 43.

In this example, the plate part 43 is provided only on the side end guide 41. However, the plate part 43 may be formed also on the side end guide 42. Or, the plate part 43 is provided on each of the side end guide 41 and the side end guide 42.

As shown in FIGS. 2, 6, and 7, the portion on the upper surface at the rear end of the plate part 43 serves as a backward-feed prevention surface 43*a*. The backward-feed prevention surface 43*a* extends horizontally and parallel to the upper surface of the second sheet feeding tray 40. It is noted that when the second sheet feeding tray 40 is slid frontward (the state shown in FIGS. 6 and 7), the rear end of the backward-feed prevention surface 43*a* of the plate part 43 is located in front of and in the vicinity of the lower front edge 81 of the print part 80. The backward-feed prevention surface 43*a* is in such a vertical height slightly higher than the vertical height of the lower front edge 81 of the print part 80 in the state where the second sheet feeding tray 40 is slid frontward (the state shown in FIGS. 6 and 7), thereby making minimum a gap between the second sheet feeding tray 40 and the lower front edge 81 of the print part 80. Thus, the backward-feed prevention surface 43*a* serves as a backward-feed prevention part for preventing the printed sheet from being fed by the feeding unit 50 back to the print part 80 again.

As shown in FIGS. 2, 6, and 7, a front side extension 44 is formed at the front side of the plate part 43. That is, the front side extension 44 is a plate shape that extends forwardly from the front edge of the plate part 43. The front side extension 44 includes a main part 44*a* and an inclined part 44*b* which are arranged in the front-to-rear direction. The inclined part 44*b* is connected to the plate part 43. The main part 44*a* is located in front of the inclined part 44*b*. Thus, the main part 44*a* is connected to the front edge of the plate part 43 via the inclined part 44*b*. The upper surface of the main part 44*a* extends horizontally and parallel to the upper surface of the second sheet feeding tray 40. The upper surface of the main part 44*a* is in such a vertical height higher than the upper surface of the plate part 43. The inclined part 44*b* smoothly connects the main part 44*a* to the plate part 43.

As shown in FIG. 7, the plate part 43 and the front side extension 44 cooperate to substantially cover the sheets stored in the second sheet feeding tray 40 in the front-back direction. That is, when the sheet feeding cassette 3 is pulled out the image forming apparatus 1, pre-printed sheets are stored in the second sheet feeding tray 40 so that the sheets are located below the plate part 43 and the front side extension 44. Then, the sheet feeding cassette 3 is mounted in the image forming apparatus 1. In the state where the second sheet feeding tray 40 is slid rearward, the rear end of the plate part 43 reaches the vicinity of the feeding roller 60.

It is noted that when the second sheet feeding tray 40 is slid rearward (the state shown in FIGS. 2, 4, and 5), the main part 44*a* of the front side extension 44 is located in front of and in the vicinity of the lower front edge 81 of the print part 80. The upper surface of the main part 44*a* of the front side extension 44 is in such a vertical height slightly higher than the vertical height of the lower front edge 81 of the print part 80 in the state where the second sheet feeding tray 40 is slid rearward (the state shown in FIGS. 2, 4, and 5), thereby making minimum the gap between the second sheet feeding tray 40 and the lower front edge 81 of the print part 80. So, the main part 44*a* of the front side extension 44 serves as another backward-feed prevention part for preventing the printed sheet from being fed by the feeding unit 50 back to the print part 80.

It is noted that in the state where the second sheet feeding tray 40 is slid rearward (the state shown in FIGS. 2, 4, and 5), the backward-feed prevention surface 43*a* is located below the print part 80 because the second sheet feeding tray 40 moves gradually downwardly as the second sheet feeding tray 40 moves to the rear.

As shown in FIG. 2, on the front side of the side end guide 42, a right-side extension 45 is formed to extend outwardly (rightwardly) from the upper edge of the front end of the side end guide 42. The upper surface of the right-side extension 45 extends horizontally and parallel to the upper surface of the second sheet feeding tray 40. The upper surface of the right-side extension 45 is in such a vertical height substantially the same as the upper surface of the main part 44*a* of the front side extension 44. It is noted that when the second sheet feeding tray 40 is slid rearward (the state shown in FIGS. 2, 4, and 5), the right-side extension 45 is located in front of and in the vicinity of the lower front edge 81 of the print part 80. The upper surface of the right-side extension 45 is in such a vertical height slightly higher than the vertical height of the lower front edge 81 of the print part 80 when the second sheet feeding tray 40 is slid rearward (the state shown in FIGS. 2, 4, and 5), thereby making minimum the gap between the second sheet feeding tray 40 and the lower front edge 81 of the print part 80. So, the upper surface of the right-side extension 45 serves as another backward-feed prevention part for preventing the printed sheet from being fed back to the print part 80.

A backward-feed prevention protrusion 70 is formed on the upper surface of the second sheet feeding tray 40 at a location on the outer side (left side) of the backward-feed prevention surface 43*a* of the plate part 43. The backward-feed prevention protrusion 70 is for preventing the printed sheet from being fed to the print part 80 again. The backward-feed prevention protrusion 70 serves to mainly prevent rearward feeding of the relatively large standard sheet that has been fed from the first sheet feeding tray 30. The backward-feed prevention protrusion 70 is of a substantially triangular shape when viewed from the side, and has a top 70*a* and a pair of gently-inclined surfaces 70*b* and 70*c*. The pair of gently-inclined surfaces 70*b* and 70*c* extend downwardly from the top 70*a* to the front and to the rear, respectively. It is noted that when the second sheet feeding tray 40 is slid frontward (the state shown in FIG. 6), the backward-feed prevention protrusion 70 is located in front of and in the vicinity of the lower front edge 81 of the print part 80. The top 70*a* is configured to have a height substantially the same as the backward-feed prevention surface 43*a*, thereby making minimum the gap between the second sheet feeding tray 40 and the lower front edge 81 of the print part 80 in the state where the second sheet feeding tray 40 is slid frontward (the state shown in FIG. 6).

Next will be described, with referring to FIG. 4 to FIG. 7, functions of the backward-feed prevention surface 43*a*, the main part 44*a* of the front side extension 44, the right-side extension 45, and the backward-feed prevention protrusion 70 of the second sheet feeding tray 40. FIGS. 4 and 5 show the state where the second sheet feeding tray 40 is slid rearward. FIGS. 6 and 7 show the state where the second sheet feeding tray 40 is slid frontward.

As shown in FIG. 4 and FIG. 5, in the state where the second sheet feeding tray 40 is slid rearward, the main part 44*a* of the front side extension 44 and the right-side extension 45 are located in front of and in the vicinity of the lower front edge 81 of the print part 80. The main part 44*a* of the front side extension 44 and the right-side extension 45 make minimum the gap between the second sheet feeding tray 40 and the lower front edge 81 of the print part 80. Thus, when the small-sized sheet stored in the second sheet feeding tray 40 is fed by the feeding unit 50 to the print part 80 along the U-shaped conveyance guide 90 and then, discharged in the direction opposite to the sheet feeding direction and mounted on the plate part 43, even if the user tries to take out the printed sheet and pushes the sheet toward the back side with mistake, since there is only a slight gap between the main part 44*a* of the front side extension 44 and the right side extension 45 and the print part 80, the printed sheet is not fed to the print part 80 again. Therefore, there is no possibility that paper jam occurs on the conveyance path, and a desired image can be formed smoothly.

As shown in FIG. 6 and FIG. 7, in the state where the second sheet feeding tray 40 is slid frontward, the backward-feed prevention surface 43*a* and the backward-feed prevention protrusion 70 are in front of and in the vicinity of the lower front edge 81 of the print part 80. The backward-feed prevention surface 43*a* and the backward-feed prevention protrusion 70 make minimum the gap between the second sheet feeding tray 40 and the lower front edge 81 of the print part 80. Thus, when the standard sheet stored in the first sheet feeding tray 30 is fed by the feeding unit 50 to the print part 80 and then, discharged in the direction opposite to the sheet feeding direction and mounted on the plate part 43, even if the user tries to take out the printed sheet and pushes the sheet toward the back side with mistake, since there is only a slight gap between the backward-feed prevention surface 43*a* and the backward-feed prevention protrusion 70 and the print part 80, the printed sheet is not fed to the print part 80 again. Therefore, there is no possibility that paper jam occurs on the conveyance path, and a desired image can be formed smoothly.

While the invention has been described in detail with reference to the embodiment thereof, it would be apparent to those skilled in the art that various changes and modifications may be made therein without departing from the spirit of the invention.

What is claimed is:

1. An image forming apparatus comprising:

a print part;

a feeding part;

a first sheet feeding tray which stores a first sheet having a first size therein, the feeding part feeding the first sheet from the first sheet feeding tray to the print part in a sheet feeding direction;

a second sheet feeding tray which is mounted on the first sheet feeding tray and which stores a second sheet having a second size smaller than the first size therein, the feeding part feeding the second sheet from the second sheet feeding tray to the print part in the sheet feeding direction, the second sheet feeding tray receiving a printed sheet printed by the print part and discharged in a direction opposite to the sheet feeding direction, wherein the second sheet feeding tray is configured to selectively move between a first position and a second position, and the second sheet feeding tray covers a larger portion of the first sheet feeding tray when the second sheet feeding tray is at the first position than when the second sheet feeding tray is at the second position a first backward-feed prevention part which prevents the printed sheet from being fed to the print part again when the second sheet feeding tray is at the first position; and a second backward-feed prevention part which prevents the printed sheet from being fed to the print part again when the second sheet feeding tray is at the second position, wherein when the second sheet feeding tray is at the first position, the first sheet feeding tray is configured to place the first sheet in contact with the feeding part, to prevent the second sheet stored in the second sheet feeding tray from being fed by the feeding part, and when the second sheet feeding tray is at the second position, the second sheet feeding tray is configured to place the second sheet in contact with the feeding part, to prevent the first sheet stored in the first sheet feeding tray from being fed by the feeding part.

2. The image forming apparatus according to claim 1, wherein the second sheet feeding tray has a pair of side guides which are provided in parallel to the sheet feeding direction and which contact against side ends of the sheet of the second side to guide the second sheet to the print part, at least one of the pair of side guides comprises a plate part which extends from an upper edge of the side guide to the other side guide and which is configured to receive the printed sheet thereon, and at least one of the first backward-feed prevention part and the second backward-feed prevention part is disposed on the plate part.

3. The image forming apparatus as stated in claim 1, wherein when the second sheet feeding tray is at the first position, a vertical height of the first backward-feed prevention part is greater than a vertical height of a lower edge of the print part, and when the second sheet feeding tray is at the second position, a vertical height of the second backward-feed prevention part is greater than the vertical height of the lower edge of the print part.

4. The image forming apparatus of claim 2, wherein at least one of the first backward-feed prevention part and the second backward-feed prevention portion is formed on the upper surface of the second sheet feeding tray and on an outer side of the side guide.

5. A sheet feeding cassette configured to be removably attached to an image forming apparatus having a print part and a feeding part, the sheet feeding cassette comprising:

a first sheet feeding tray configured to store a first sheet of a first size therein, wherein the feeding part is configured to feed the first sheet from the first sheet feeding tray to the print part in a sheet feeding direction; and a second sheet feeding tray which is mounted on the first sheet feeding tray and which is configured to store a second sheet of a second size smaller than the first size therein, wherein the feeding part is configured to feed the second sheet from the second sheet feeding tray to the print part in the sheet feeding direction, wherein the second sheet feeding tray is configured to receive a printed sheet printed by the print part and discharged in a direction opposite to the sheet feeding direction, and the second sheet feeding tray is configured to selectively move between a first position and a second position, and the second sheet feeding tray is configured to cover a larger part of the first sheet feeding tray when the second sheet feeding tray is positioned at the first position than when the second sheet feeding tray is positioned at the second position;

a first backward-feed prevention part configured to prevent the printed sheet from being again fed to the print part when the second sheet feeding tray is at the first position; and a second backward-feed prevention part configured to prevent the printed sheet from being again fed to the print part when the second sheet feeding tray is at the second position, wherein when the second sheet feeding tray is in the first position, the first sheet feeding tray is configured to bring the first sheet into contact with the feeding part to prevent the second sheet stored in the second sheet feeding tray from being fed by the feeding part and when the second sheet feeding tray is at the second position, the second sheet feeding tray is configured to bring the second sheet into contact with the feeding part.

6. The sheet feeding cassette according to claim 5, wherein the second sheet feeding tray comprises a pair of side guides which are provided in parallel to the sheet feeding direction and which contact against side ends of the second sheet to guide the second sheet to the print part, at least one of the pair of side guides comprises a plate part which extends from an upper edge of the side guide to the other side guide and is configured to receive the printed sheet thereon, and at least one of the first backward-feed prevention part and the second backward-feed prevention part is formed on the plate part.

* * * * *